US006746537B2

(12) United States Patent
Fukuda et al.

(10) Patent No.: US 6,746,537 B2
(45) Date of Patent: Jun. 8, 2004

(54) COATING APPARATUS

(75) Inventors: Tsutomu Fukuda, Anpachi-gun (JP); Toshihiko Kanayama, Anpachi-gun (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 10/224,196

(22) Filed: Aug. 19, 2002

(65) Prior Publication Data

US 2003/0037728 A1 Feb. 27, 2003

(30) Foreign Application Priority Data

Aug. 24, 2001 (JP) ..... 2001-254763
Dec. 20, 2001 (JP) ..... 2001-388530

(51) Int. Cl.[7] ..... B05C 3/02
(52) U.S. Cl. ..... 118/411; 118/419
(58) Field of Search ..... 118/413, 419, 118/411, 410; 427/356; 425/466

(56) References Cited

U.S. PATENT DOCUMENTS 4,854,262 A 8/1989 Chino et al. ..... 118/411
5,067,432 A * 11/1991 Lippert
5,318,804 A * 6/1994 Yoshida
5,425,967 A * 6/1995 Tomaru

FOREIGN PATENT DOCUMENTS

JP 62-241574 A1 10/1987

* cited by examiner

*Primary Examiner*—Brenda A. Lamb
(74) *Attorney, Agent, or Firm*—Darby & Darby

(57) ABSTRACT

In order to provide a coating apparatus in which an edge can be fixed rigidly so as to apply a coating agent at a uniform thickness, edge units are provided which comprise edge support members and edges which are attached to the tips of the edge support members so as to slide on a flexible tape support member. The edge which is not disposed at both ends in the running direction of the flexible tape support member is fixed to the edge support member by an edge fixing member which is inserted in a direction from a bottom portion of the coating apparatus toward the edge. The edge is fixed so as to be pulled into a recessed section formed on the edge support member by the edge fixing member.

4 Claims, 4 Drawing Sheets

PRIOR ART

PRIOR ART

COATING APPARATUS

BACKGROUND OF THE INVENTION

1. Field of the Invention

The present invention relates to a coating apparatus for coating a thin layer of A coating agent on a running flexible tape support member. The present invention particularly relates to a coating head for ejecting the coating agent.

2. Description of Related Art

As a coating head for forming a thin coating layer, a structure such as disclosed in Japanese Unexamined Patent Application, First Publication No. Sho 62-241574 (hereinafter called first prior art) is generally known. As shown in FIG. 5, a coating head 5 has two parallel members 1, 2. Between the parallel members 1, 2, a slot 3 is formed. At both ends in the longitudinal direction of the slot 3, regulating members 4, 4 are disposed for regulating the width of the slot 3.

In the coating head 5 having such a structure, when a long wide flexible tape support member 6 runs on the tips of parallel edge members in the direction indicated by arrow A in the drawing, a coating agent is ejected from the slot 3 toward the flexible tape support member 6; thus, the coating agent is coated on one surface of the flexible tape support member 6 at a uniform thickness.

A coating apparatus having more than two slots so as to coat a plurality of coating layers is shown in FIG. 6 (hereinafter called second prior art).

The coating apparatus shown as the second prior art is provided with a coating head for coating a coating agent on the long wide running flexible tape support member as shown in FIG. 6. As shown in the drawing, the coating head 10 has three edge units, i.e., a first edge unit 13, a second edge unit 14, and a third edge unit 15, which are disposed in this order in the running direction (indicated by arrow B in the drawing) of a flexible tape support member 23. A first slot 11 is formed between the first edge unit 13 and the second edge unit 14, and a second slot 12 is formed between the second edge unit 14 and the third edge unit 15 such that the coating agent flows toward the flexible tape support member 23.

These first, second, and third edge units 13, 14, and 15 comprise a first, second, and third edge supporting members 13*a*, 14*a*, and 15*a* which are made of an iron-based alloy and first, second, and third edges 20, 21, and 22 which are made of a cemented carbide alloy and attached to the tips of the first, second, and third edge supporting members 13*a*, 14*a*, and 15*a* facing to the flexible tape support member 23 press against the flexible tape support member 23.

The coating apparatus has a coating agent supply device, which is not shown in the drawing for supplying coating agents 30A and 30B. The coating agents 30A and 30B are pumped through pockets 33, 34, the first slot 11, and the second slot 12, and pushed out of each outlet of the first and the second slots 11, 12 to be ejected in the directions indicated by arrows C1 and C2. The coating agents 30A and 30B are layered on one surface of the flexible tape support member 23 which is fed by a feeding device, not shown in the drawing, in the direction indicated by arrow B.

Here, the thickness of the coating agent which is coated on the flexible tape support member is several microns to several tens microns; therefore, the width of the slots in which the coating agents flow tends to be narrow. When a coating agent flows through such a slot, quite a large amount of friction occurs between the coating agent and the slot. Thus, there is a problem in that it is difficult to control the post-coating thickness of the coating agent uniformly because liquid pressure deviations occur in the coating agent when the friction becomes larger than required.

Therefore, from a design point of view for removing bumps on the slot surface as much as possible so as to decrease such friction, the slot surface of the edge supporting member is subjected to polish finishing.

As shown in FIG. 3, when making the constitution of the first prior art, edges 42, 43 are fixed on edge supporting members 40, 41 by edge fixing members 44*a*, 44*b* disposed on side surfaces 47, 48 which are on the opposite sides of edge supporting members 40, 41 with respect to slot surfaces 46*a*, 46*b*.

However, when making the constitution of the second prior art both surfaces of the second edge 21 form slot surfaces 25*a*, 25*b* which constitute the slots 11, 12 as shown in FIG. 4. Therefore, when the edge 21 is fixed to the second edge supporting member 14*a* by the same fixing method as that of the first prior art, the flatness of the slot surfaces 25*a*, 25*b* becomes significantly impaired. Thus, the friction due to the coating agent increased; thus, there has been a concern that uniform control of the thickness of the coating layer would be difficult.

The present invention was made in consideration of the above-mentioned problem. The object of the present invention is to provide a coating apparatus in which an edge made of a hard material such as cemented carbide can be fixed rigidly without any adverse effect on the flatness of the slot surfaces.

SUMMARY OF THE INVENTION

In order to solve the above-mentioned problem, the coating apparatus according to the present invention has the following structure.

The coating apparatus has a coating head for coating a coating agent on a flexible tape support member which runs in one direction. The coating head has a plurality of edge units which are disposed in the running direction of the flexible tape support member. Slots for passing the coating agent toward the flexible tape support member are formed between the edge units. Edge units comprise edge support members and edges which are attached to the tips of the edge support members so as to slide on the flexible tape support member. Among the edges, at least the edge which is not disposed at both ends in the running direction of the flexible tape support member is fixed to the edge support member by an edge fixing member which is inserted in the direction from the bottom portion of the coating apparatus toward the edge.

In such a structure, the flatness of the slot surfaces is not deteriorated by the edge fixing member for fixing the edges to the edge supporting members. Therefore, the friction of the coating agent is prevented from increasing. Liquid pressure deviations during the ejection of the coating agent are suppressed, and the post-coating thickness of the coating layer can be controlled uniformly.

Furthermore, as the flatness of the slot surfaces improves, the coating agent becomes more separable from the slots. Thus, it is possible to prevent the coating agent from becoming hard and adhering to the slot surfaces. Such improvements helps in the cleaning of the slots for maintaining the coating apparatus.

Also, in the present invention, the edge is fixed in a state in which it is pulled into a recessed section provided at the tip of the edge support member by the edge fixing member.

In such a structure, the edge is fixed rigidly by utilizing wedge effect; thus, backlash of the edge is effectively restrained. The flatness of the slot surfaces can be improved by using such a structure. Also, liquid pressure deviations during the ejection of the coating agent can be suppressed effectively over a long period of time.

As explained above, by the present invention, among the edges, at least the edge which is not disposed at both ends in the running direction of the flexible tape support member is fixed to the edge support member by the edge fixing member which is inserted in the direction from the bottom portion of the coating apparatus toward the edge. Therefore, the flatness of the surfaces forming the slots is not deteriorated. By such a structure, friction during the ejection of the coating agent decreases, thus, liquid pressure deviations can be suppressed. Therefore, it is possible to form multiple layers at a uniform thickness.

Also, the edge is fixed in a state in which it is pulled into a recessed section provided at the tip of the edge support member by the edge fixing member. Therefore, the edge is fixed to the edge supporting member rigidly by a wedge effect. Thus, the backlash of the edge is restrained, and the flatness of the slot surfaces of the slot can be maintained for a long period of time. Also, it is possible to form multiple layers at a uniform thickness for a long period of time.

DETAILED DESCRIPTION OF THE INVENTION

Embodiments of the coating apparatus according to the present invention are explained as follows with reference to the drawings. Although the present invention relates to a coating apparatus for uniformly coating surfaces of a flexible tape support member such as a film and a sheet running in one direction, by a coating agent so as to form a thin coated layer, the specific structural and functional details disclosed herein are merely representative and do not limit the scope of the present invention.

Figure 1:
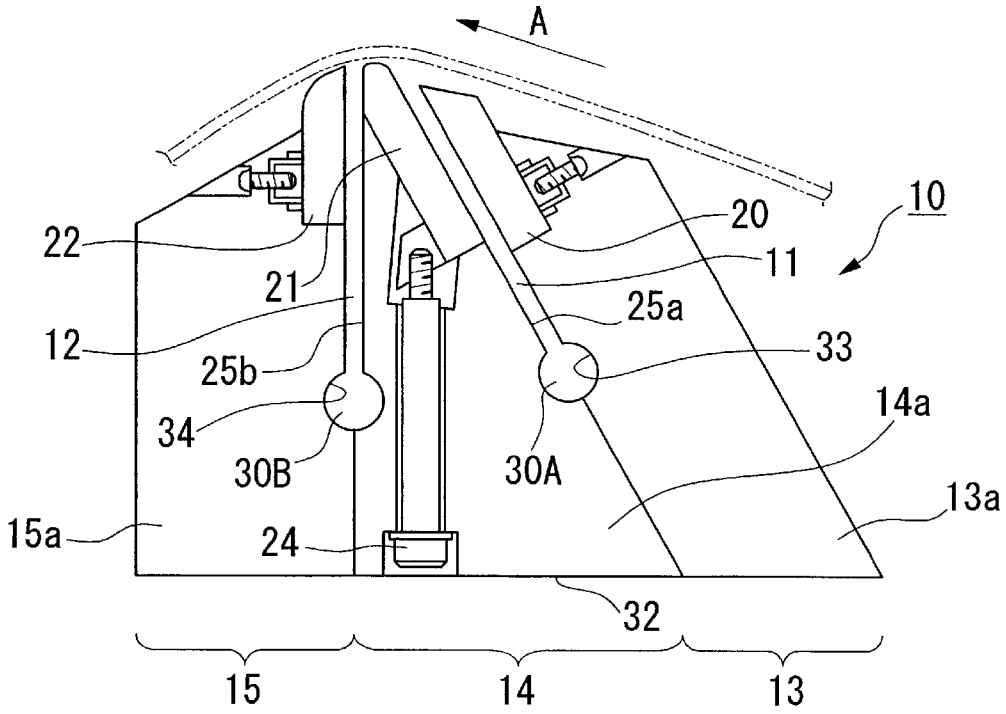
FIG. 1 is a cross section of a coating head.

An embodiment of the coating apparatus according to the present invention is shown in FIG. 1. In FIG. 1, the coating apparatus has a coating head 10. In the coating head 10, a first slot (slot) 11, which is formed between a first edge unit 13 and a second edge unit 14, and a second slot (slot) 12, which is formed between the second edge unit 14 and a third edge unit 15, are formed. The first, second, and third edge units 13, 14, and 15 are disposed in this order in the running direction indicated by arrow A of a flexible tape support member 23. First, second, and third edges 20, 21, and 22 made of cemented carbide are attached to the tips of the first, second, and third edge supporting members (edge supporting members) 13*a*, 14*a*, and 15*a* made of iron-based alloy.

In the coating apparatus, coating agents 30A, 30B are supplied by a coating agent supplying device, which is not shown in the drawing, while the flexible tape support member 23 is running. The coating agents 30A, 30B pass through pockets 33, 34, the first slot 11, and the second slot 12; thus, the coating agents 30*a*, 30B are layered on one surface of the flexible tape support member 23.

In the present embodiment, the coating agent is applied to form a base member of a green sheet for a layered ceramics condenser. The coating agent is made of a liquid containing a dielectric ceramic powder and a liquid containing a dielectric component which is somewhat different from the above-mentioned dielectric ceramic powder.

As shown in FIG. 1, the second edge unit 14 is structured such that both sides of the second edge 21 form slot surfaces 25*a*, 25*b* which are disposed on the outside of the edge unit 14, and a clamping bolt 24 (fixing member) is inserted in a bottom portion 32 of the second edge supporting member 14*a*; thus, the second edge 21 is fixed on the second edge supporting member 14*a*.

By such a structure, it is not necessary that the clamp bolt 24 be disposed on the slot surfaces 25*a*, 25*b*; thus, the slot surfaces 25*a*, 25*b* can be made flat. Therefore, it is possible to prevent the friction of the coating agent from increasing, and also liquid pressure deviations during the ejection of the coating agent are suppressed; thus, it is possible to obtain a uniform thickness of the multiple layers.

Figure 2:
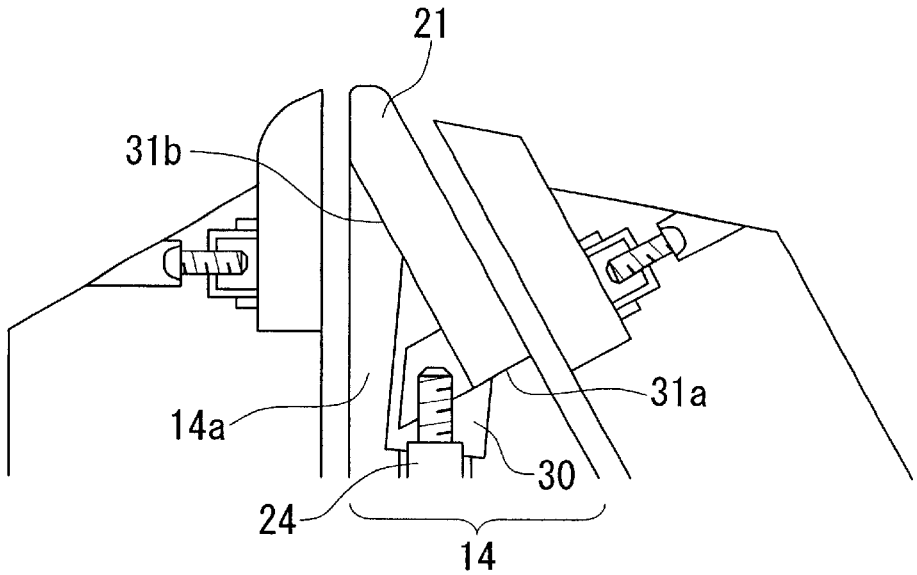
FIG. 2 a cross section showing the details of the coating head.
Figure 3:
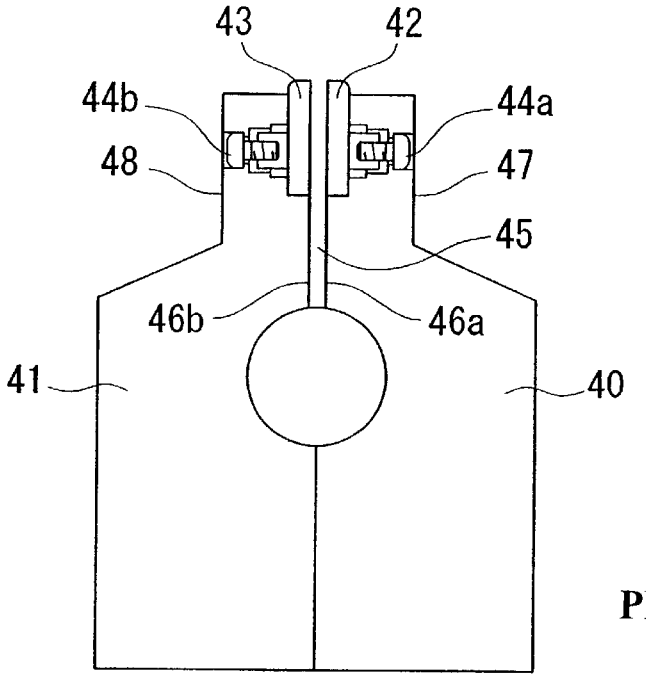
FIG. 3 is a schematic diagram showing a method for attaching an edge when there is one slot.
Figure 4:
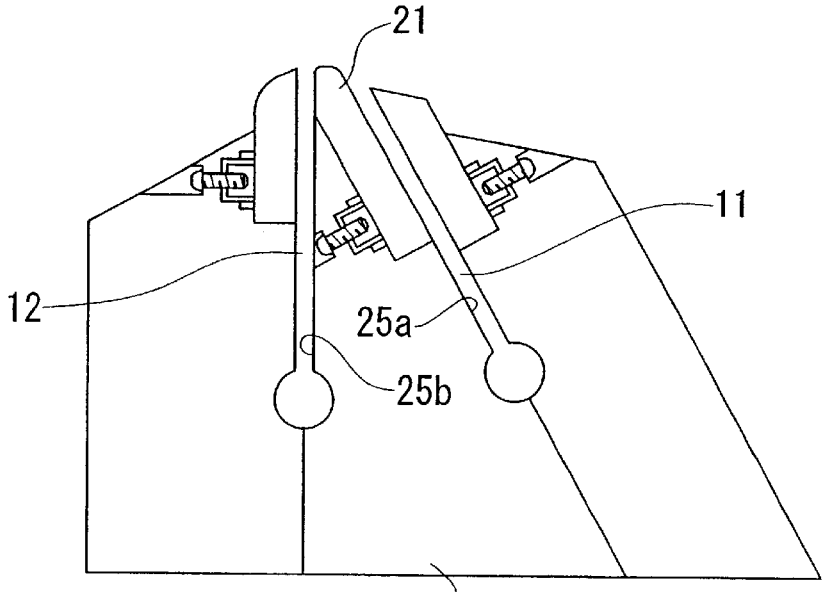
PRIOR ART FIG. 4
FIG. 4 is a schematic diagram showing a method for attaching an edge when there are two slots.
Figure 5:
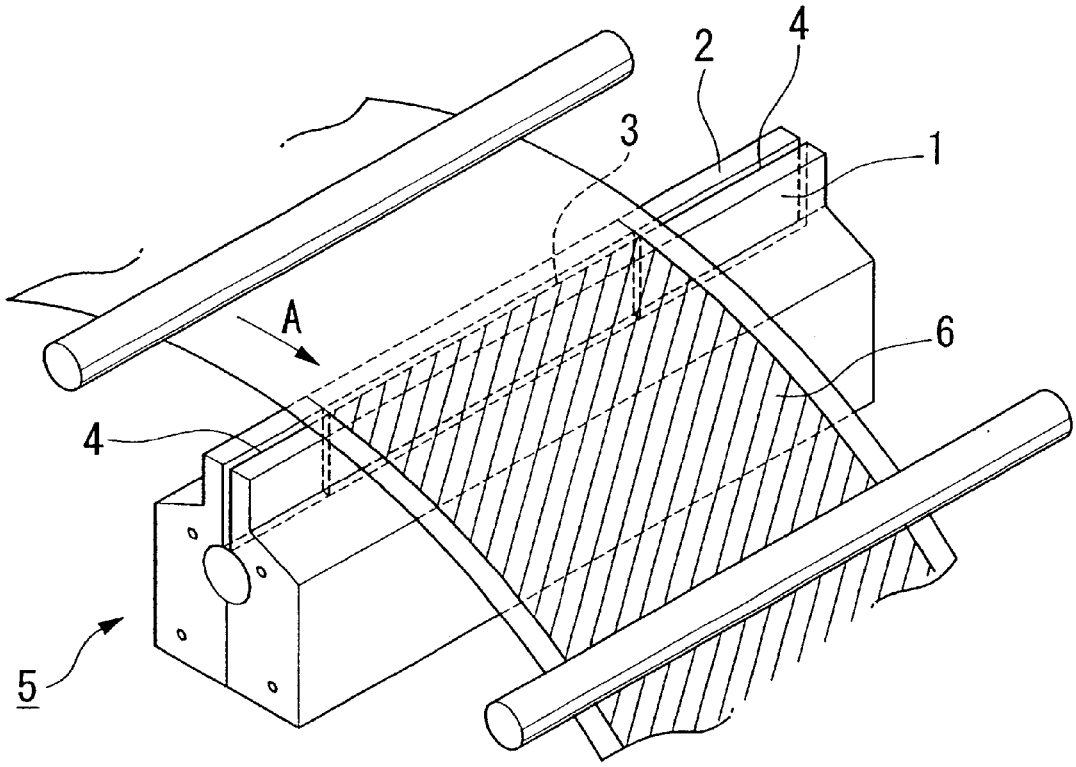
FIG. 5 is a perspective view of a conventional coating apparatus having one slot.
Figure 6:
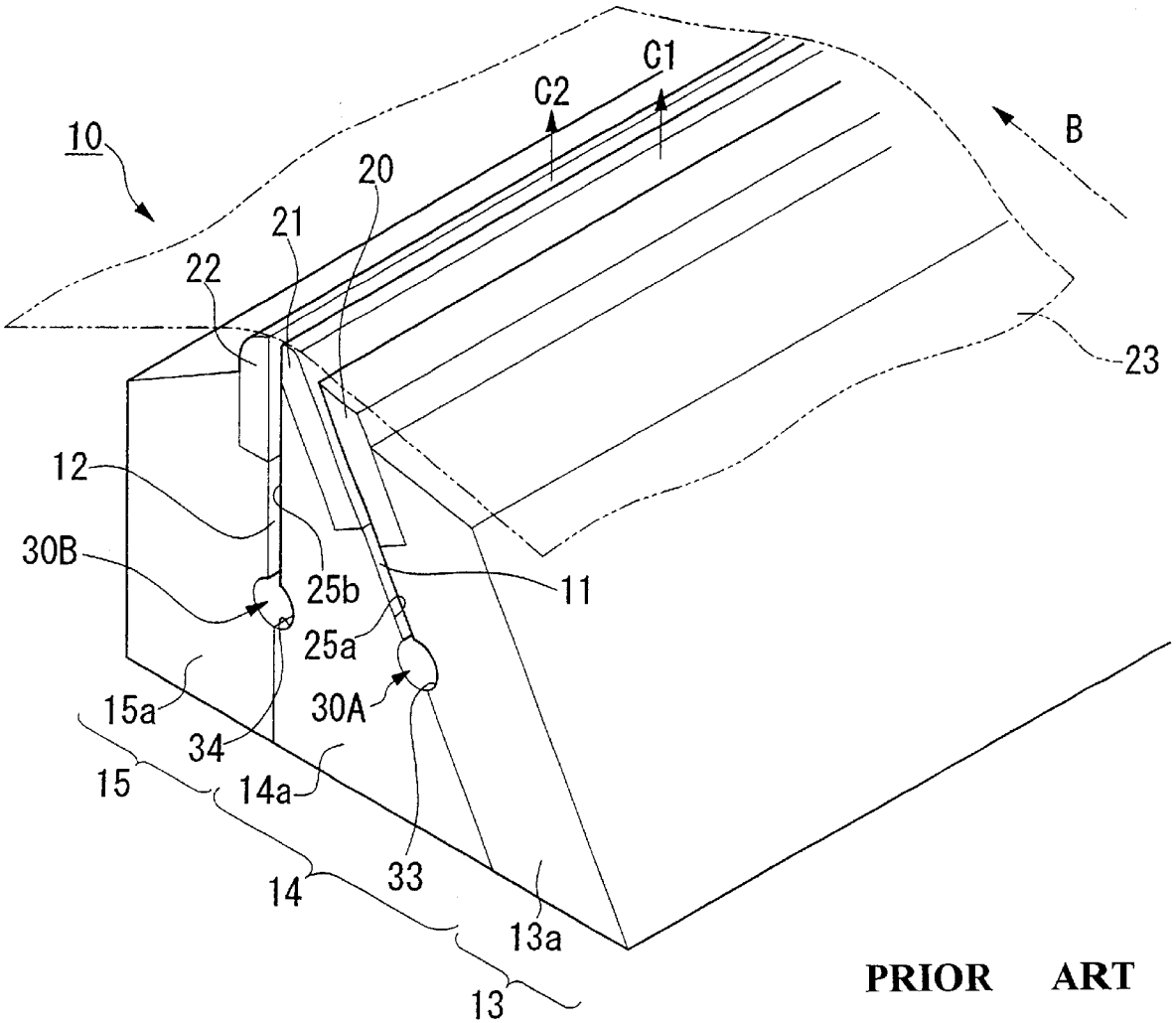
PRIOR ART FIG. 6
FIG. 6 is a perspective view of a conventional coating apparatus having two slots.

Furthermore, FIG. 2 shows the detailed structure of the second edge unit 14. In the second edge unit 14, a recessed section 30 is formed on the tip of the second edge supporting member 14*a*, and the second edge 21 is disposed in the recessed section 30. The second edge 21 is fixed such that the second edge 21 is pulled into the recessed section 30 by the clamp bolt 24 so as to be fixed to the second edge supporting member 14*a*.

By such a structure, the second edge 21 is rigidly fixed to the second edge supporting member 14*a* by a wedge effect caused by being pushed against mutually perpendicular surfaces 31*a*, 31*b* in the recessed section 30. Thus, the backlash of the second edge 21 is restrained effectively. Also, in connecting portions between the second edge 21 and the second edge supporting member 14*a*, the flatness can be maintained. Thus, liquid pressure deviations during the ejection of the coating agent are suppressed for a long period of time, and furthermore, the forming of multiple layers at a uniform thickness can be realized.

In the present embodiment of the coating apparatus, three edge units 13, 14, and 15 are employed so as to form two thin coating layers on the flexible tape support member 23, however, it is acceptable if more than three coating agents are applied to the flexible tape support member 23. As long as the fixing method for fixing the edge having slot surfaces on both sides of the edge remains unchanged, a structure having more than three edge units for the coating head is acceptable.

What is claimed is:

1. A coating apparatus comprising:

a coating head for applying a coating agent on a flexible tape support member which runs in one direction;

the coating head comprising:

a first, a second, and a third edge unit which are disposed in the running direction of the flexible tape support member;

a plurality of slots for passing the coating agent toward the flexible tape support member, wherein the plurality of slots are formed between the first, the second, and the third edge units;

the first, the second, and the third edge units comprising an edge supporting member having a tip arranged at one end of the respective edge supporting member and a bottom surface arranged at the oppositely facing end of the respective edge supporting member;

the first, the second, and the third edge units further comprising an edge positioned adjacent to the flexible tape support member and in communication with the tip of the edge supporting member;

the second edge unit disposed between the first and the third edge units;

the second edge unit comprising an edge fixing member located in the bottom surface of the second edge unit edge supporting member; and the edge fixing member being in communication with the edge of the second edge unit such that the edge of the second edge unit is fixed on the tip of the second edge unit edge supporting member.

2. A coating apparatus according to claim 1, wherein the edges are attached to the tip of the edge supporting members so as to slide on the flexible tape support member.

3. A coating apparatus according to claim 1 wherein the edge of the second edge unit is fixed into a recessed section formed on the tip of the second edge unit edge supporting member by the edge fixing member.

4. A coating apparatus according to claim 1 comprising two or more second edge units.

* * * * *